US010355359B1

(12) United States Patent
Butscher et al.

(10) Patent No.: US 10,355,359 B1
(45) Date of Patent: Jul. 16, 2019

(54) AXIAL CHOKE HORN ANTENNA

(71) Applicant: LOCKHEED MARTIN CORPORATION, Bethesda, MD (US)

(72) Inventors: Frank Butscher, San Marcos, CA (US); Joseph T. Loane, San Francisco, CA (US); William Jay Dawley, Boulder Creek, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 174 days.

(21) Appl. No.: 15/283,184

(22) Filed: Sep. 30, 2016

(51) Int. Cl.

| | |
|---|---|
| ***H01Q 5/55*** | (2015.01) |
| ***H01Q 1/42*** | (2006.01) |
| ***H01Q 1/36*** | (2006.01) |
| ***H01Q 21/24*** | (2006.01) |

(52) U.S. Cl.
CPC ..... *H01Q 5/55* (2015.01); *H01Q 1/36* (2013.01); *H01Q 1/42* (2013.01); *H01Q 21/24* (2013.01)

(58) Field of Classification Search
CPC ..... H01Q 5/55; H01Q 1/42; H01Q 13/0266; H01Q 13/065
See application file for complete search history.

(56) References Cited

U.S. PATENT DOCUMENTS 4,929,962 A * 5/1990 Begout ..... H01P 11/00 343/772
2002/0149537 A1* 10/2002 Ohara ..... H01Q 1/242 343/895
2004/0108963 A1* 6/2004 Clymer ..... H01P 1/161 343/837
2014/0111400 A1* 4/2014 Latrach ..... H01Q 15/0086 343/878

FOREIGN PATENT DOCUMENTS

WO WO2004059786 * 7/2014

OTHER PUBLICATIONS

The American Radio Relay League, Gerald Hall, 1988.*

* cited by examiner

*Primary Examiner* — Jessica Han
*Assistant Examiner* — Awat M Salih
(74) *Attorney, Agent, or Firm* — Morgan, Lewis & Bockius LLP

(57) ABSTRACT

An antenna includes a horn including an axial waveguide and a circular radome including a central cavity. The circular radome is configured to protrude into the axial waveguide. The antenna further includes a coil element provided over a coil frame and configured to fit inside the central cavity. The horn includes a conical structure having multiple circular chokes that are configured to shape a beam of the antenna to provide a desired gain by reducing sidelobes.

11 Claims, 3 Drawing Sheets

AXIAL CHOKE HORN ANTENNA

STATEMENT REGARDING FEDERALLY SPONSORED RESEARCH OR DEVELOPMENT

This invention was made with government support under Contract No. HO14712C0004 MDA awarded by the U.S. government. The government has certain rights in the invention.

FIELD OF THE INVENTION

The present invention generally relates to antenna design, and more particularly, to an axial choke horn antenna.

BACKGROUND

Horn antennas can provide moderate to high gain, which make them a good candidate for microwave and millimeter wave communication bands. These bands are used by many telecommunication technologies such as wireless networks, and direct-broadcast satellites which broadcast television and radio directly into consumers' homes. The high frequency of microwaves provides the microwave band with a substantial information-carrying capacity. For example, the microwave band has a bandwidth that is thirty times larger than the bandwidth of the entire radio spectra at lower frequency bands. The small wavelength associated with the microwave allows the use of conveniently-sized antennas (e.g., horn antennas) to direct them in narrow beams. Such narrow microwave beams can be pointed directly at the receiving antenna, thereby facilitating their use for point-to-point communications, such as communication between a satellite and a ground station.

SUMMARY

According to various aspects of the subject technology, methods and configurations for providing an axial choke horn antenna are described. The axial choke horn antenna of the subject technology provides a prescribed circularly polarized gain over desired angle of coverage with a substantially accurate circular beam. The disclosed axial choke horn antenna can maintain a low profile within a small volume and with a light weight.

In some other aspects, an antenna includes a horn including an axial waveguide and a circular radome including a central cavity. The circular radome is configured to protrude into the axial waveguide. The antenna further includes a coil element provided over a coil frame and configured to fit inside the central cavity. The horn includes a conical structure having multiple circular chokes that are configured to shape a beam of the antenna to provide a desired gain by reducing sidelobes.

In other aspects, a method for providing a conical antenna includes providing a conical horn including an axial waveguide and coupling a radome to the conical horn. The radome includes a circular cavity. A coil frame including grooves is provided and a coil element is placed inside grooves of the coil frame. The coil frame is placed inside the circular cavity. Providing the conical horn comprises providing a conical structure including a plurality of circular chokes and configuring the plurality of circular chokes to shape a beam of the conical antenna to provide a desired antenna gain by reducing sidelobes.

In yet other aspects, a communication system includes a high-gain conical horn antenna and a transceiver circuit coupled to the high-gain conical horn antenna. The transceiver circuit is configured to communicate over one or more communication bands including microwave and millimeter wave bands. The high-gain conical horn antenna comprises a conical horn including an axial waveguide and a circular radome including a circular cavity. The circular radome is configured to protrude into the axial waveguide. The antenna further includes a metallic coil frame including helical grooves, and a coil element placed inside the helical grooves. The coil frame including the coil element is configured to fit inside the axial waveguide. The conical horn includes a conical structure including multiple circular chokes that are configured to shape a beam of the antenna to provide a predefined gain by reducing sidelobes.

The foregoing has outlined rather broadly the features of the present disclosure in order that the detailed description that follows can be better understood. Additional features and advantages of the disclosure will be described hereinafter, which form the subject of the claims.

BRIEF DESCRIPTION OF THE DRAWINGS

For a more complete understanding of the present disclosure, and the advantages thereof, reference is now made to the following descriptions to be taken in conjunction with the accompanying drawings describing specific aspects of the disclosure, wherein.

DETAILED DESCRIPTION

The detailed description set forth below is intended as a description of various configurations of the subject technology and is not intended to represent the only configurations in which the subject technology can be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and can be practiced using one or more implementations. In one or more instances, well-known structures and components are shown in block diagram form in order to avoid obscuring the concepts of the subject technology.

The present disclosure is directed, in part, to methods and configurations for providing an axial choke horn antenna. In some aspects, the disclosed horn antenna is a wide flare angle circular horn with axial chokes and can create a circular shaped beam with low side-lobes. The low side-lobes allow providing a high-gain throughout the desired angle of scan, for example, about 8 dB circularly polarized gain within a 3 dB beam width. Achieving high gains, at the beam extremities, with other antenna solutions, in particular, with comparable dimensions (e.g., the small volume and height of the subject horn antenna) may be nearly impossible. In some aspects, the impedance match to the axial choke horn is achieved by an input inverse-tapered short helix that is imbedded in a tapered dielectric located inside of a short circular waveguide. The inverse-tapered short helix is further used to generate the required low value axial ratio of the circularly polarized radio-frequency (RF) wave. This disclosed antenna solution can be quite light weight by virtue of its short internal parts and thin wall construction of the circular waveguide and corrugated horn.

Figure 1:
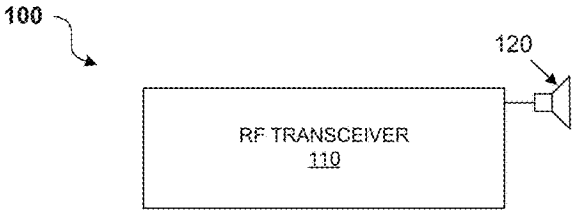
FIG. 1 is a high-level diagram illustrating an example communication system using an axial choke horn antenna, according to certain aspects of the disclosure.

FIG. 1 is a high-level diagram illustrating an example communication system 100 using an axial choke horn antenna 120, according to certain aspects of the disclosure. The communication system 100 may include a radio-frequency (RF) transceiver 110 coupled to the horn antenna 120. The communication system 100 may be part of a satellite communication system. For example, that RF transceiver 110 may be a transceiver of a satellite or a ground station, and may operate at a multi GHz frequency. The horn antenna 120 can be a stand-alone antenna or an efficient prime focus for a dish antenna of the communication system 100.

In some aspects, the horn antenna 120 is a high-gain antenna that can achieve a high (e.g., about 8 dB) circularly polarized gain within a 3-dB beamwidth. In some aspects, the high gain can be achieved in a cylindrical volume of about $5\lambda^3$, diameter of about $1.8\lambda$, and at approximately 15% bandwidth and voltage standing wave ratio (VSWR) of less than about 2 to 1, where $\lambda$ is the wavelength corresponding to the operating frequency of the horn antenna 120.

Figure 2:
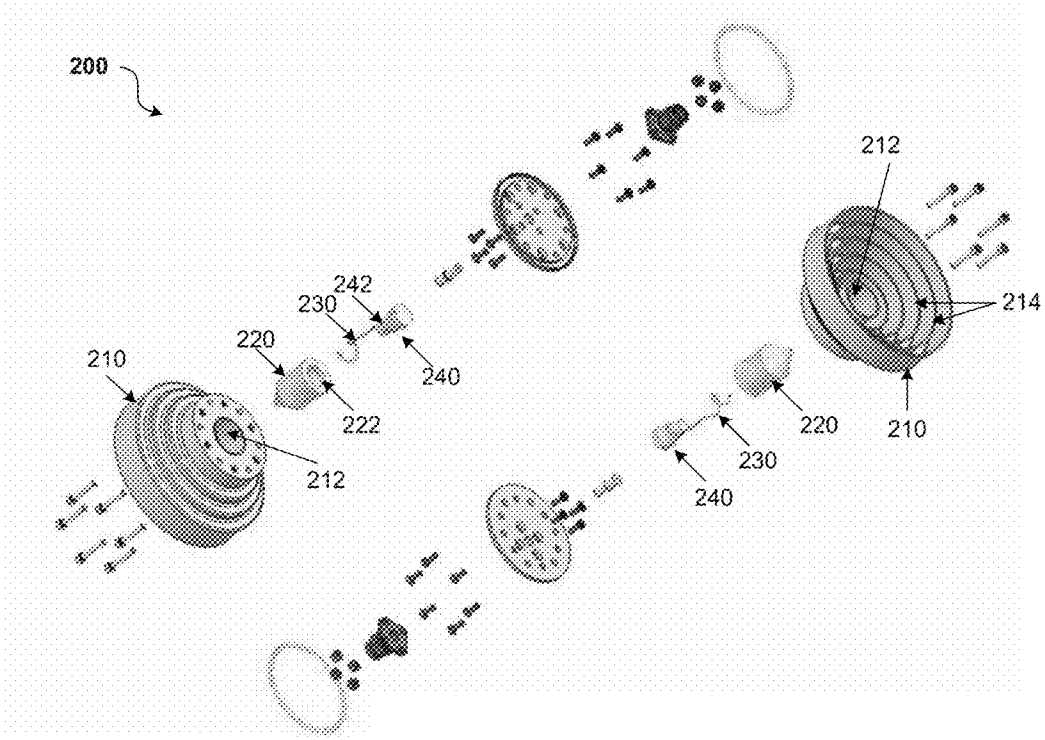
FIG. 2 illustrates exploded views of an example of an axial choke horn antenna, according to certain aspects of the disclosure.

FIG. 2 illustrates exploded views of an example of an axial choke horn antenna 200, according to certain aspects of the disclosure. In the exploded views of the horn antenna 200 shown in FIG. 2, only the main components are numerated and discussed herein. Other components such as screws, fittings, washers, and the like are known parts and not of interest herein. The horn antenna 200 includes a conical horn 210, a radome 220, a coil element 230, and a coil frame 240.

The conical horn 210 includes an axial waveguide 212 and a number of circular chokes 214. The axial waveguide 212 is a cylindrical hole (opening) in the center of the conical horn 210. The circular chokes 214 are made of a number of concentric circular blades that are configured to shape a beam of the horn antenna 200. For example, the circular chokes 214 can shape the beam of the horn antenna 200 into a circular beam. The circular chokes 214 can be configured to provide the desired gain. In other words, the number of concentric circular blades and their respective dimensions, as explained below, can play a role in reducing the sidelobes of the antenna pattern, which results in a higher gain for the horn antenna. In some implementations, the conical horn 210 can be made of one or more materials including, for example, aluminum, titanium, zinc, or magnesium. In one or more aspects, other materials may be used.

In one or more aspects, the radome 220 is a circular radome that includes a central cavity 222. When the horn antenna 200 is assembled, the radome 220 is configured to protrude into the axial waveguide 212 of the conical horn 210. In some implementations, the radome 220 can be made of one or more materials including, for example, rexolite, teflon, ceramic, polyethylene, or any other low-loss dielectric material. In some aspects, the shape of the radome may contribute to aperture efficiency of the horn antenna and the impedance matching of the horn antenna to a transceiver circuit.

In some aspects, the coil frame 240 can be made of aluminum and includes helical groves 242 that can hold the coil elements 230. The coil element 230 is the antenna feed element (also referred to as a curl feed) can be made of one or more material including, for example, beryllium, copper, and gold. In some aspects, the coil element 230 can be made of gold-plated beryllium copper. When the horn antenna 200 is assembled, the coil frame 240 including the coil element 230 fits inside the cavity 222 of the radome 220. In some aspects, the circular structure of the coil element 230 enables formation of a circularly polarized antenna beam. The coil element 230 is coupled to a transceiver (e.g., 110 of FIG. 1) via a connector (e.g., a subminiature version A (SMA) connector).

Figure 3B:
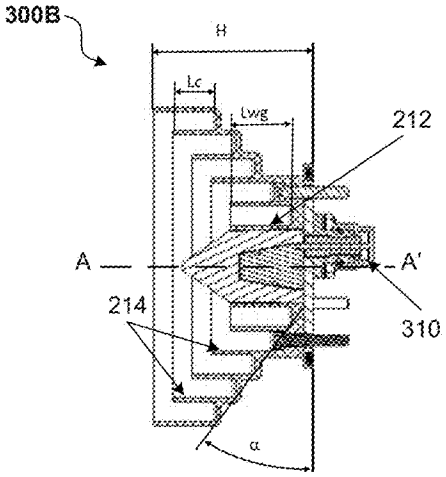
FIGS. 3A-3B are a top view and a cross-sectional view of an example axial choke horn antenna, according to certain aspects of the disclosure.
Figure 3A:
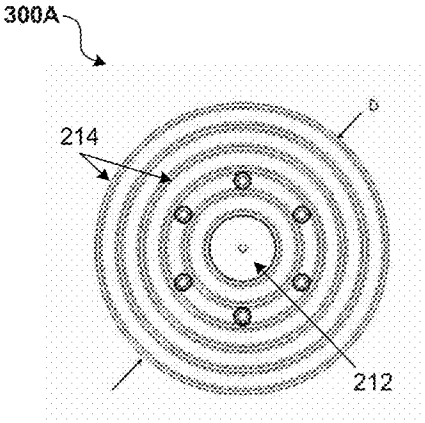

FIGS. 3A-3B are a top view 300A and a cross-sectional view 300B of an example axial choke horn antenna, according to certain aspects of the disclosure. The top view 300A shows the circular chokes 214 and the axial waveguide 212 discussed above. The dimension D of the circular horn is about $1.8\lambda$, and weight of the circular horn is related to the wavelength and is given, for a horn made in aluminum, to be approximately equal to $0.05\lambda^3$, where $\lambda$ is the wavelength corresponding to the carrier frequency (f) in inches, and the weight is given in pounds. For example, for a carrier frequency of 1 GHz, the dimension D is about 54 cm and the axial choke horn antenna weighs about 37 Kilograms.

The cross-sectional view 300B shows the circular chokes 214 and a connector 310 (e.g., SMA connector) that can be used to connect the curl feed (e.g., coil element 230) to a transceiver (e.g., 110 of FIG. 1). The contour of tips of the multiple concentric circular blades of the circular chokes 214 are seen to be at a predefined angle ($90-\alpha$) with respect to an axis AA' of the circular horn, where an example value of $\alpha$ is about 33.5 degrees and can be changed to provide a desired antenna gain. This is because the amount of sidelobes of the radiation pattern of the horn antenna is determined by the angle $\alpha$ and other shape parameters, such as the length Lc of the circular blades, which can be, for example, about $0.25\lambda$. In some aspects, the length Lwg of the axial waveguide 212 is about $0.36\lambda$, where $\lambda$ is the wavelength corresponding to the carrier frequency (f) in inches.

Figure 4:
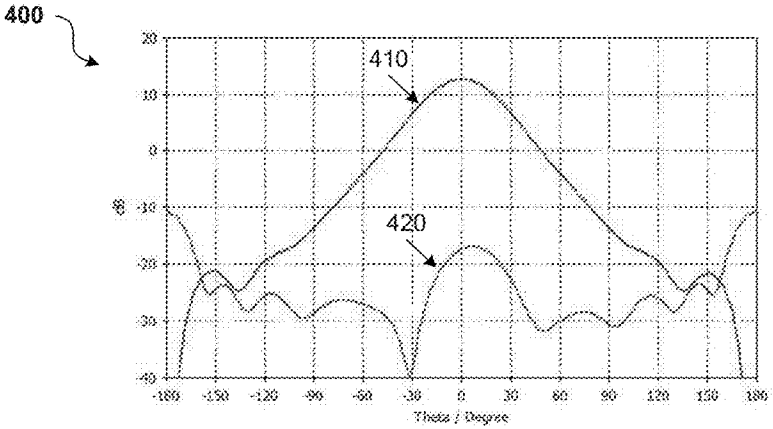
FIG. 4 is a chart illustrating plots of antenna gain of an example axial choke horn antenna, according to certain aspects of the disclosure.

FIG. 4 is a chart 400 illustrating plots 410 and 420 of antenna gain of an example axial choke horn antenna, according to certain aspects of the disclosure. As described above the circular chokes (e.g., 214 of FIG. 2) of an axial choke horn antenna of the subject technology (e.g., 200 of FIG. 2) can effectively reduce the sidelobes, which results in an increased gain of the horn antenna. The plot 410 shows a right hand circular polarization (RHCP) antenna gain (in dB) versus the coverage angle theta (in degrees). As seen from plot 410 a highest RHCP gain of the disclosed horn antenna is about 13 dB. The disclosed horn antenna can achieves a high circularly polarized gain of 8 dB within a 3 dB beam width. In some aspects, the high gain can be achieved in a cylindrical volume of about $5\lambda^3$, diameter of about $1.8\lambda$, and at approximately 15% bandwidth and voltage standing wave ratio (VSWR) of less than about 2 to 1, where $\lambda$ is the wavelength corresponding to the operating frequency of the horn antenna 200. The plot 420 depicts a left hand circular polarization (LHCP) antenna gain (in dB). A peak of the LHCP antenna gain is about −16 dB. In terms of performance, the disclosed horn antenna is capable of achieving more than 70% aperture efficiency.

Figure 5:
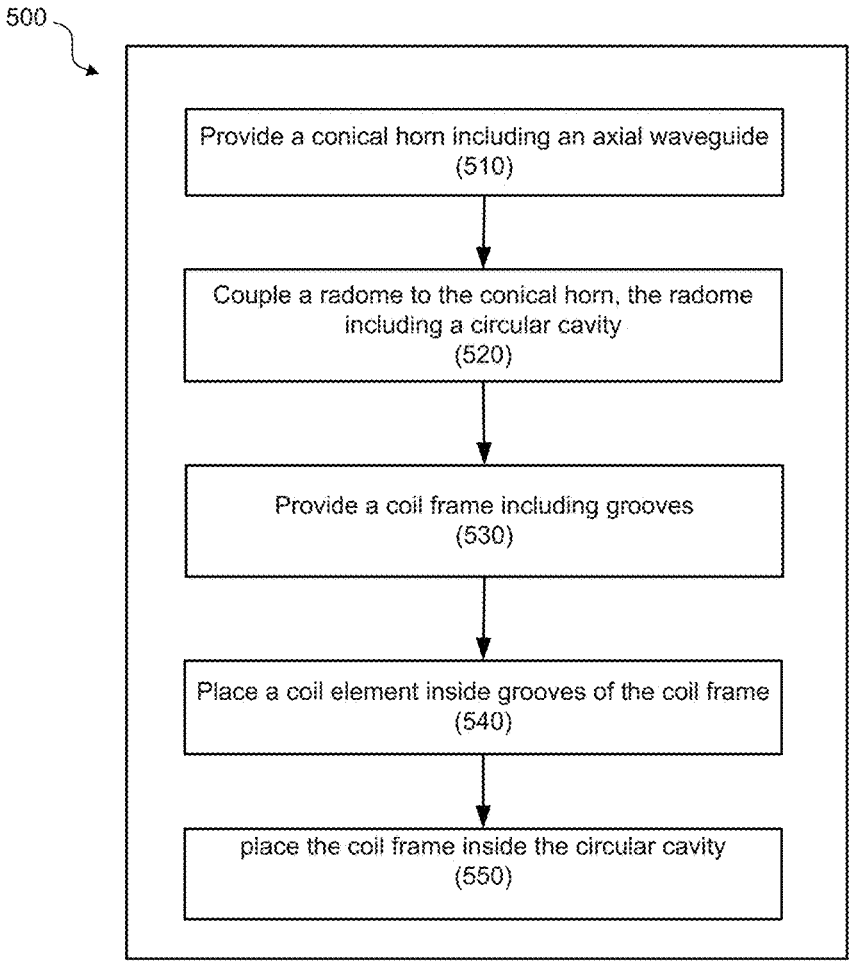
FIG. 5 is a flow diagram illustrating an example of a method for providing an axial choke horn antenna, according to certain aspects of the disclosure.

FIG. 5 is a flow diagram illustrating an example of a method 500 for providing an axial choke horn antenna, according to certain aspects of the disclosure. The method 500 begins with providing a conical horn (e.g., 210 of FIG. 2) including an axial waveguide (e.g., 212 of FIG. 2) (510) and coupling a radome (e.g., 220 of FIG. 2) to the conical horn, the radome including a circular cavity (e.g., 222 of FIG. 2) (520). A coil frame (e.g., 240 of FIG. 2) including grooves (e.g., 242 of FIG. 2) is provided (530). A coil element (e.g., 230 of FIG. 2) is placed inside grooves of the coil frame (540). The coil frame is placed inside the circular cavity (550). Providing the conical horn comprises providing a conical structure including a plurality of circular chokes (e.g., 214 of FIG. 2) and configuring the circular chokes to shape a beam of the conical antenna to provide a desired antenna gain by reducing sidelobes (e.g., see plot 410 of FIG. 4). In some aspects, the disclosed antenna can be used as a stand-alone antenna or an efficient prime focus for a dish antenna.

The description of the subject technology is provided to enable any person skilled in the art to practice the various aspects described herein. While the subject technology has been particularly described with reference to the various figures and aspects, it should be understood that these are for illustration purposes only and should not be taken as limiting the scope of the subject technology.

A reference to an element in the singular is not intended to mean "one and only one" unless specifically stated, but rather "one or more." The term "some" refers to one or more. Underlined and/or italicized headings and subheadings are used for convenience only, do not limit the subject technology, and are not referred to in connection with the interpretation of the description of the subject technology. All structural and functional equivalents to the elements of the various aspects described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

Although the invention has been described with reference to the disclosed aspects, one having ordinary skill in the art will readily appreciate that these aspects are only illustrative of the invention. It should be understood that various modifications can be made without departing from the spirit of the invention. The particular aspects disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative aspects disclosed above may be altered, combined, or modified and all such variations are considered within the scope and spirit of the present invention. While compositions and methods are described in terms of "comprising," "containing," or "including" various components or steps, the compositions and methods can also "consist essentially of" or "consist of" the various components and operations. All numbers and ranges disclosed above can vary by some amount. Whenever a numerical range with a lower limit and an upper limit is disclosed, any number and any subrange falling within the broader range are specifically disclosed. Also, the terms in the claims have their plain, ordinary meaning unless otherwise explicitly and clearly defined by the patentee. If there is any conflict in the usages of a word or term in this specification and one or more patent or other documents that may be incorporated herein by reference, the definitions that are consistent with this specification should be adopted.

What is claimed is:

1. An antenna comprising:

a horn including an axial waveguide;

a circular radome including a central cavity and configured to protrude into the axial waveguide; and a coil element provided over a coil frame and configured to fit inside the central cavity, wherein the horn comprises a conical structure including a plurality of concentric circular blades, wherein a contour of tips of the plurality of concentric circular blades are at a predefined angle with respect to an axis of the horn, wherein the predefined angle comprises 90-$\alpha$ degrees, and wherein $\alpha$ is within a range of about 30 to 40 degrees and is configured to provide a desired gain.

2. The antenna of claim 1, wherein coil frame comprises a metallic coil frame comprising aluminum, and wherein the coil frame includes helical grooves.

3. The antenna of claim 2, wherein the coil element comprises one or more material including at least one of beryllium, copper, and gold, and wherein the coil element is configured to fit into the helical grooves of the coil frame.

4. The antenna of claim 2, wherein the coil element is configured to facilitate formation of a circularly polarized antenna beam.

5. The antenna of claim 1, wherein the plurality of concentric circular chokes blades are configured to shape a beam of the antenna to reduce sidelobes.

6. The antenna of claim 1, wherein respective heights of the multiple concentric circular blades and the predefined angle with respect to the axis of the horn are configured to provide a desired antenna gain.

7. The antenna of claim 1, wherein the horn comprises of one or more materials including at least one of aluminum, titanium, and magnesium.

8. The antenna of claim 1, wherein the circular radome comprises one or more materials including rexolite, Teflon, ceramic polyethylene, or any other low-loss dielectric material, and wherein a shape of the circular radome may contribute to an impedance matching and an aperture efficiency of the antenna.

9. The antenna of claim 1, wherein the antenna comprises a compact and light weight antenna having a largest dimension of about 54 cm and a weight of about 37 Kg, at 1 GHz operating frequency, and wherein the antenna is capable of achieving about 70% aperture efficiency.

10. The antenna of claim 1, wherein the desired gain comprises a high gain characterized by a highest right hand circular polarization (RHCP) antenna gain of about 13 dB, and wherein the antenna is capable of achieving about 70% aperture efficiency.

11. The antenna of claim 1, wherein the plurality of circular chokes are configured to shape the beam of the antenna to provide a circular shaped beam.

* * * * *